United States Patent [19]

Boyce et al.

[11] 3,985,132

[45] Oct. 12, 1976

[54] FILTER MASK

[75] Inventors: Elvin L. Boyce; William Keith Robinson, both of Salt Lake City, Utah

[73] Assignee: Tape-Licator, Inc., Riverton, Utah ; a part interest

[22] Filed: Dec. 13, 1974

[21] Appl. No.: 532,340

[52] U.S. Cl. ..... 128/146.2

[51] Int. Cl.[2] ..... A62B 23/02

[58] Field of Search ..... 128/139, 140 R, 146.2, 128/146, 146.6

[56] References Cited

UNITED STATES PATENTS

| | | | |
|---|---|---|---|
| 3,170,461 | 2/1965 | Watts, Jr. | 128/146.2 |
| 3,802,429 | 4/1974 | Bird | 128/146.2 |
| 3,884,227 | 5/1975 | Lutz et al. | 128/146.2 |

FOREIGN PATENTS OR APPLICATIONS

| | | | |
|---|---|---|---|
| 5,104 | 12/1913 | United Kingdom | 128/146.2 |

*Primary Examiner*—William E. Kamm

*Attorney, Agent, or Firm*—H. Ross Workman; J. Winslow Young

[57] ABSTRACT

An improved filter mask having a laterally pleated filter medium and a stiffening member parallel to and in the vicinity of the pleats. Lateral opening of the pleats causes the stiffening members to bow outwardly and support the filter medium away from the nose and mouth of the wearer thereby providing greater filtering efficiency and wearer comfort.

3 Claims, 7 Drawing Figures

FILTER MASK

BACKGROUND

1. Field of the Invention

This invention relates to surgical filter masks.

2. The Prior Art

Filter masks have historically been used to reduce the dispersion of micro organisms from the respiratory system of medical personnel involved in procedures requiring aseptic conditions, for example, surgery. The filter mask also serves to minimize the inhalation of micro organisms originating from an external source, such as a patient. Originally, filter masks were made of a woven gauze or linen material which proved to be relatively comfortable to the wearer, however, which also proved to have a relatively low filtering efficiency.

A greater degree of filtering efficiency has been obtained through the recent development of non-woven filter masks. However, the air resistance of a filter medium is generally proportional to the filtering efficiency. With greater air resistance, the non-woven filter masks currently available tend to collapse about the nose and mouth of the wearer upon inhalation, particularly after a period of use when the filter medium has become dampened through the moisture in the exhalant of the wearer. This collapse about the nose and mouth of the wearer is not only uncomfortable and bothersome, it also reduces the filtering efficiency of the filter mask by forcing a greater volume of air through the smaller surface area of the collapsed mask.

Prior art attempts in providing a framework for supporting the filter medium away from the nose and mouth of the wearer have been disclosed, for example, see U.S. Pat. Nos. 1,319,273 and 2,149,067. These, however, are bulky and present packaging and storage difficulties.

A British Pat. No. 5104AD1913 discloses a filter mask wherein the filter medium is gathered upon pulling of a draw string so as to enclose the nose and mouth with the filter mask and incorporates a vertically extending braid to partially support the filter medium away from the nose and mouth of the wearer.

Size reductions have been achieved by pleating the filter medium, for example, as disclosed in U.S. Pat. No. 3,802,429. Pleating provides only very limited support and does not prevent the eventual collapse of the filter mask about the nose and mouth of the wearer during use.

It would therefore be an improvement in the art of filter masks to provide a filter mask foldable into relatively reduced dimensional and flat configuration for ease of packaging and shipment while also providing an enlarged filtering surface having an integral support therein. The support should hold the filtering medium away from the nose and mouth of the wearer when the filter mask is expanded into its operating configuration. Such an invention is disclosed herein.

BRIEF SUMMARY AND OBJECTS OF THE INVENTION

The present invention is a filter mask fabricated from a pleated filtering medium. The pleats are integrally joined at the borders of the mask and cooperate with at least one stiffening member located in the vicinity of the pleats. The pleats extend laterally across the filter mask and upon being opened cause a reduction in the lateral dimension of the filter mask with a resultant outward bowing of the stiffening member. The bowed stiffening member supports the filter medium away from the nose and mouth of the wearer.

The filter mask includes a conventional yieldably deformable strip across the upper edge of the filter mask so as to conform the filter mask to the nasal contour of the wearer.

It is therefore an object of this invention to provide improvements in the filter mask art.

It is another object of this invention to provide a filter mask which is pleated so as to present a planar configuration prior to use and a generally hemispherical contour when the pleats are opened.

An even still further object of this invention is to provide a filter mask having laterally extending pleats and a stiffening member in the vicinity of and parallel to the pleats.

An even still further object of this invention is to provide a filter mask which has an integral stiffening member which supports the filter medium away from the nose and mouth of the wearer.

These and other objects and features of the present invention will become more fully apparent from the following description and appended claims taken in conjunction with the accompanying drawing.

DETAILED DESCRIPTION OF THE PREFERRED EMBODIMENTS

The invention is best understood by reference to the figures wherein like parts are designated with like numerals throughout.

Figure 1:
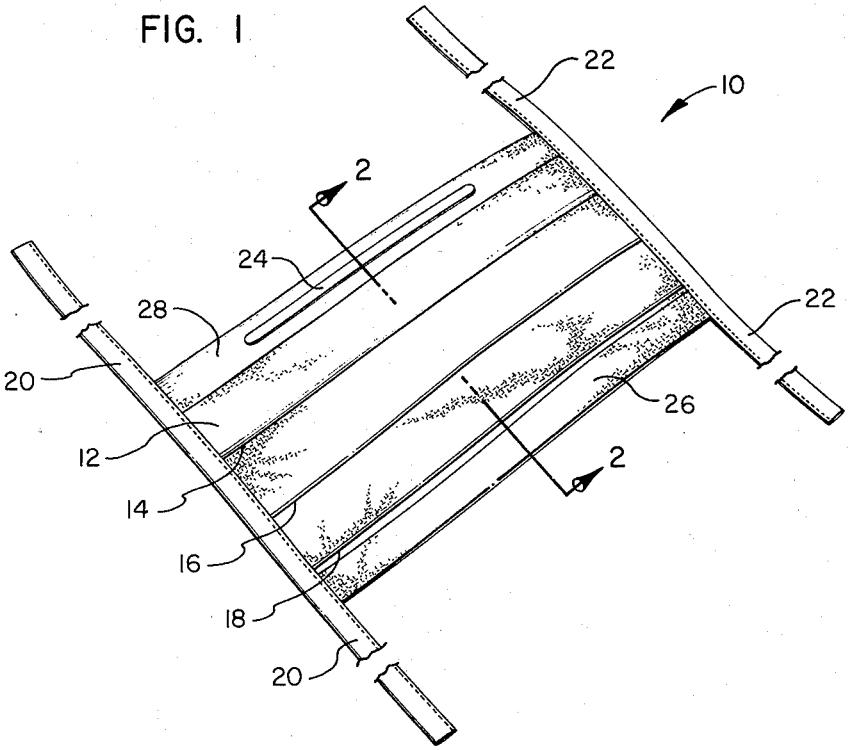
FIG. 1 is a perspective view of one filter mask embodiment of the present invention in its folded configuration.
Figure 2:
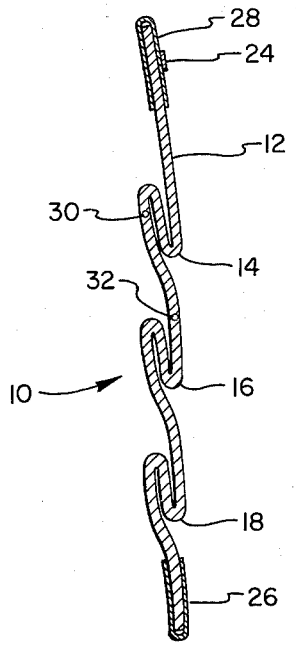
FIG. 2 is a cross-section of the mask of FIG. 1 taken along lines 2—2.
Figure 3:
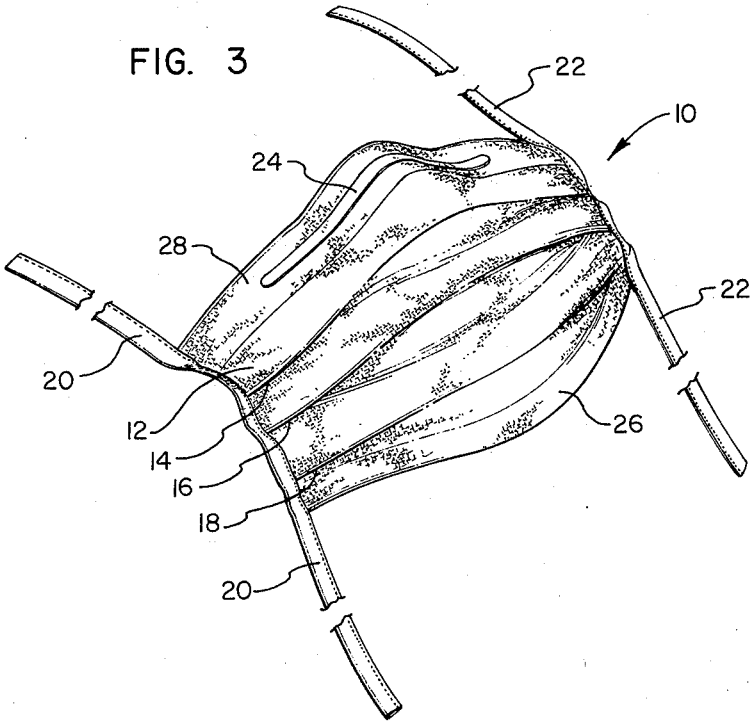
FIG. 3 is a perspective view of the filter mask of FIG. 1 in its partially opened state.
Figure 4:
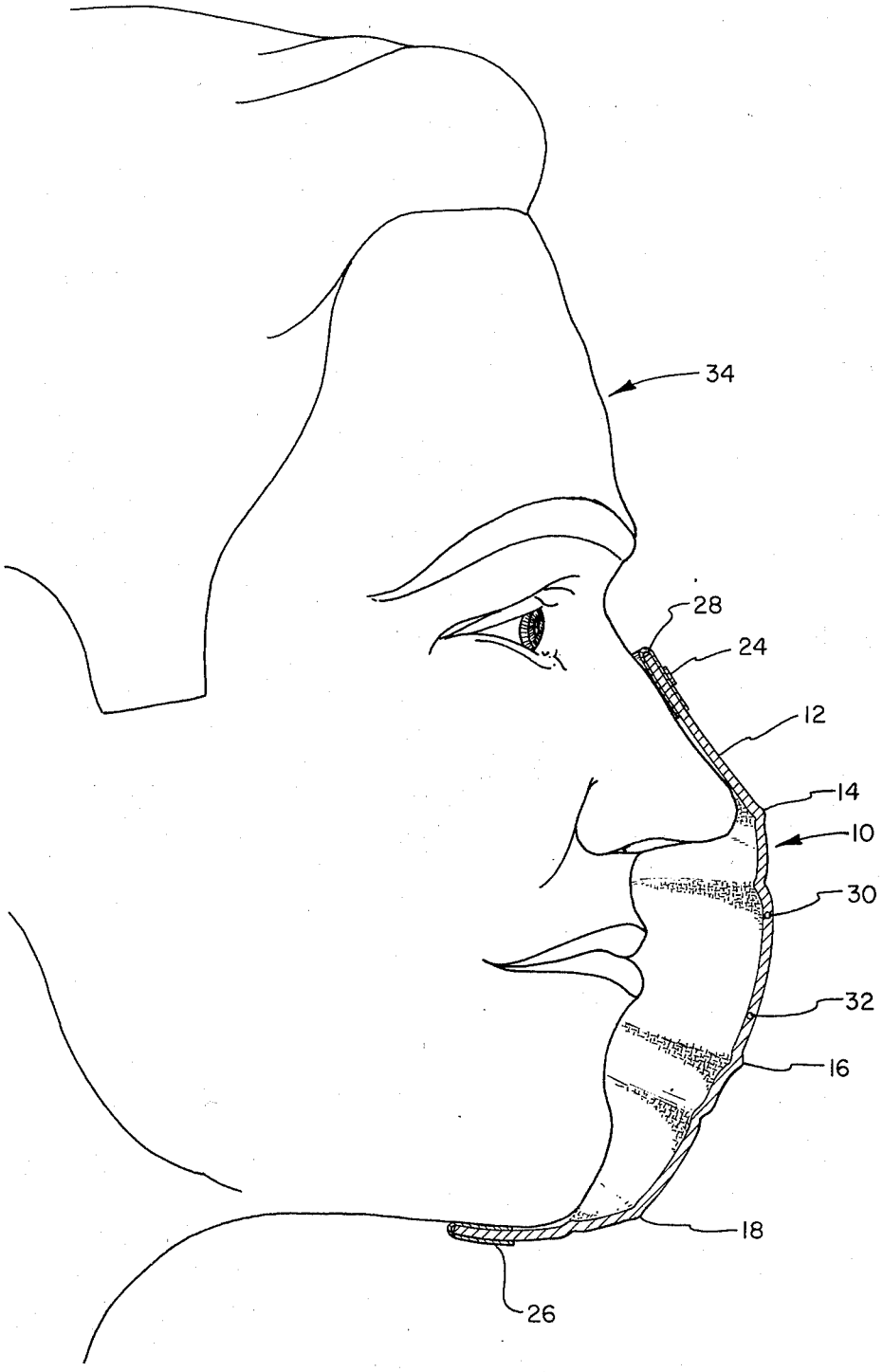
FIG. 4 is a cut away cross-section of the fully opened mask of FIG. 1 in place over the nose and mouth of a wearer.

Referring to the embodiment of FIGS. 1–4, a filter mask is shown generally at 10 and is fabricated from a rectangle segment of planar filter medium 12 which has been folded into at least one pleat. In one presently preferred embodiment, filter medium 12 is folded into three laterally extending pleats 14, 16, and 18. The ends of the pleats are joined at the borders of the filter mask by a left and a right seam binding 20 and 22, respectively. Seam binding 20 and 22 are extended beyond the borders of the filter medium 12 and provide the ties by which the mask 10 is secured (not shown) to the face of the wearer 34 (FIG. 4).

The upper border of the filter medium 12 includes a conventional yieldably deformable strip 24 which serves to selectively conform the upper border of the filter medium to the nasal contour of wearer 34 as shown in outline in FIG. 3 and in cross-section in FIG. 4.

The external configuration of filter mask 10 is completed by a seam binding 6 across the lower border and a seam binding 28 across the upper border. Seam binding 28 may include deformable strip 24 therein for simplicity of manufacture.

Referring now more particularly to FIG. 2, a cross-section of filter mask 10 reveals stiffening members 30 and 32 in the vicinity of the pleats in filter medium 12. While in this presently preferred embodiment two stiffening members 30 and 32 are shown any desirable number greater than one could be used. Stiffening member 30 is shown as an integral part of pleat 14 while stiffening member 32 is shown between pleats 14 and 16. The stiffening members extend parallel to and substantially the entire length of the pleats and may even extend to the borders as represented by seam bindings 20 and 22.

With the stiffening members 30 and 32 extending parallel with the pleats 14, 16 and 18 and the ends of the pleats being joined by seam bindings 20 and 22 any vertical opening of the pleats, for example, as shown in FIG. 3, will cause a foreshortening of the lateral dimension of filter mask 10. This lateral foreshortening of filter mask 10 causes a subsequent bowing of the stiffening members 30 and 32 causing them to bow outwardly as shown in FIG. 3 and support filter medium 12 away from the nose and mouth of the wearer 34, FIG. 4.

Stiffening members 30 and 32 may be fabricated from any suitable stiffening material such as a wire, plastic strip, or other material having a stiffening action so as to bow outwardly and support the filter medium when the pleats are opened. Desirably, the members 30 and 32 have memory to return toward a flat configuration when the mask 10 is allowed to come to rest upon a flat surface.

Figure 5:
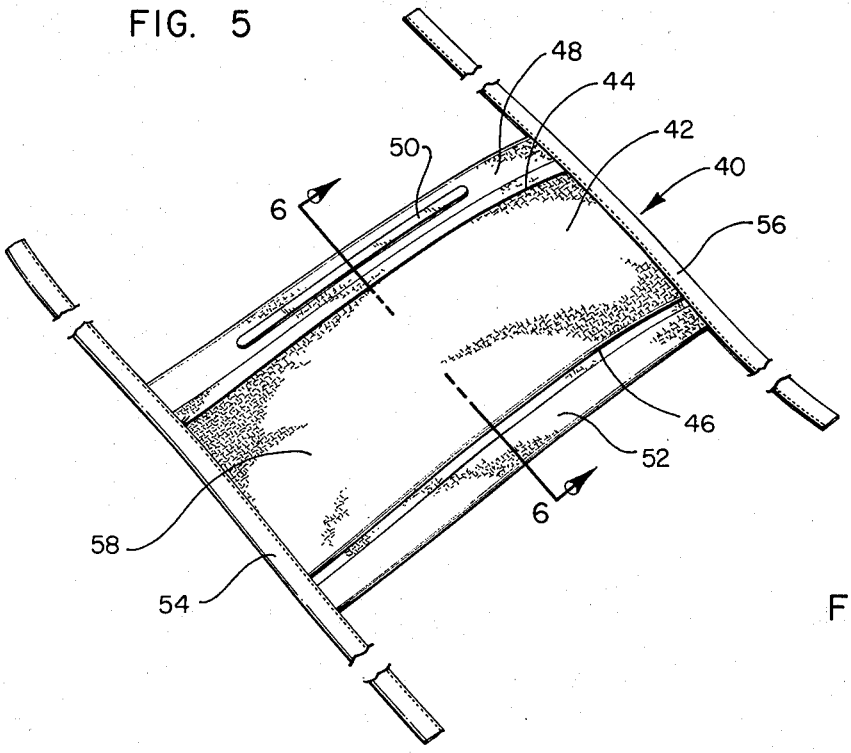
FIG. 5 is a perspective view of a second mask embodiment of this invention in its folded configuration.
Figure 6:
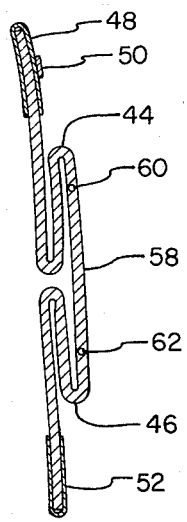
FIG. 6 is a cross-section of the mask of FIG. 5 taken along lines 6—6.
Figure 7:
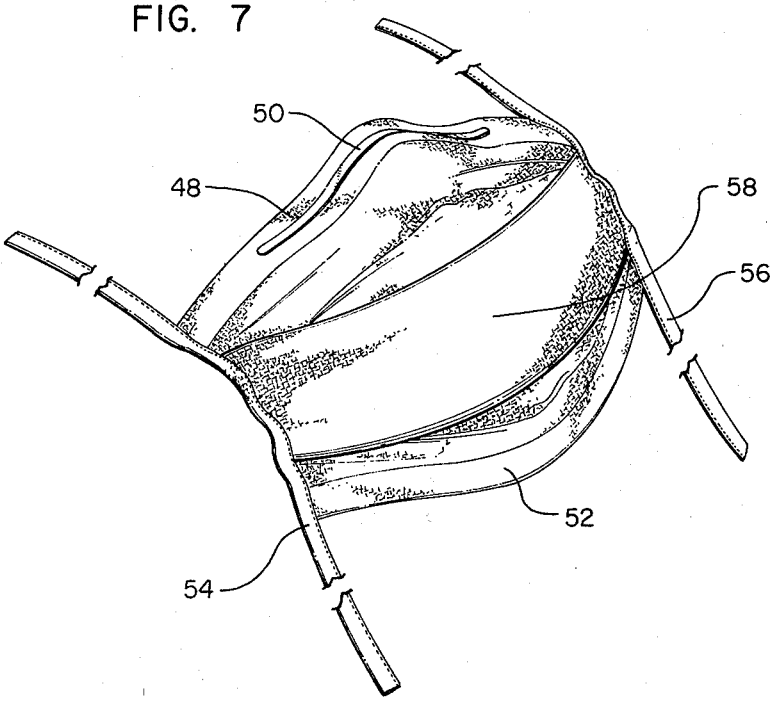
FIG. 7 is a perspective view of the mask of FIG. 5 shown in its partially opened state.

Referring now to the embodiment of FIGS. 5–7, a filter mask is shown generally at 40 and is fabricated from a rectangular section of non-woven filter medium 42. The filter medium 42 is folded into an upper pleat 44 and a lower pleat 46, shown more clearly in FIG. 6. The upper border of filter mask 40 includes a seam binding 48 and has a yieldably deformable strip 50 incorporated therewith, the deformable strip functioning similarly to the yieldably deformable strip 24 of filter mask 10. The lower edge of the filter mask 40 is completed with a seam binding 52.

The ends of each of pleats 44 and 46 are secured by a left and right seam binding 54 and 56, respectively. Both ends of seam bindings 54 and 56 extend beyond the periphery of the filter mask 40 and serve as ties for securing the filter mask to the face of a wearer (not shown) similarly to mask 10 of FIGS. 1–4.

Referring now more particularly to FIG. 6, pleats 44 and 46 are folded inwardly upon each other and present a planar segment 58 extending laterally across the face of filter mask 40. With each of pleats 44 and 46 being folded inwardly toward each other until almost touching, a greater surface area of filter medium 42 can be incorporated within the relatively confined dimensional configuration of filter mask 40 shown in FIG. 5. Planar face element 58 has incorporated therein stiffening members 60 and 62 which extend substantially the entire width of filter mask 40. Accordingly, when the filter mask 40 is extended vertically parallel to seam bindings 54 and 56 there is a concurrent foreshortening of the lateral distance between seam binding 54 and 56. This lateral foreshortening causes an outward bowing of stiffening members 60 and 62 thereby supporting the planar face element 58 in a generally hemispherical configuration as shown in FIG. 7. By this method the filter medium 42 is supported by the framework of stiffening members 60 and 62 thereby preventing collapse of the filter medium across the nose and mouth of a wearer (not shown) in a manner comparable to that shown in FIG. 4.

Accordingly, it is therefore possible to have a relatively large filter surface area available for a filter mask while at the same time being foldable into a relatively confined dimensional configuration for ease of storage, shipment, handling, etc. while simultaneously providing an integral framework which acts as a support framework for filter medium 42.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by a U.S. Letters Patent is:

1. A filter mask adapted to be worn upon the face of a wearer, the mask comprising:

an initially generally planar surface of filter medium having a vertical and a horizontal dimension and being foreshortened vertically by having at least one pleat folded into the medium, the pleat being joined at each end to the border of the planar surface;

at least one horizontally extending resilient elongated, thin stiffener secured at least at the ends thereof to the filter medium parallel to the pleat, the elongated, thin stiffener bowing outwardly upon opening of the pleat so as to exert an outward force on the mask;

attachment means for releasably securing the filter medium upon the face of a wearer; and a yieldable deformable conforming means horizontally extending across the upper edge of the filter medium so as to conform the filter medium to the nasal contour of the wearer.

2. A surgical filter mask to be worn upon the face of a wearer comprising:

a pleated filter medium, the pleats being joined at the border of the mask;

attachment means for releasably securing the filter medium upon the face of the wearer; and at least one elongated, thin stiffening member formed of flexible material with memory secured to the mask adjacent the pleat and bowing outwardly when the pleats are opened thereby supporting a portion of the filter medium away from the nose and mouth of the wearer and returning the mask to a generally planar configuration when the pleats are allowed to close.

3. An improved filter mask to be worn across the nose and mouth of a wearer comprising:

an initially planar filter medium folded into at least one pleat intermediate between an upper and a lower border, each end of the pleat being secured to each edge borders of the planar medium;

the upper border having a yieldably deformable member parallel thereto so as to selectively conform the upper border of the mask to the nasal contour of the wearer;

the improvement comprising at least one resilient elongated, thin stiffening member retained in the vicinity of and parallel to the pleat, the elongated, thin stiffening member bowing outwardly only when the pleat is opened thereby exerting an outward force on the mask so as to support the filter medium away from the nose and mouth of the wearer.

* * * * *